US008955172B2

(12) United States Patent
Culwell

(10) Patent No.: US 8,955,172 B2
(45) Date of Patent: Feb. 17, 2015

(54) WATER CLOSET FLANGE SEAL

(76) Inventor: Bill Culwell, Millerstone, PA (US)

( * ) Notice: Subject to any disclaimer, the term of this patent is extended or adjusted under 35 U.S.C. 154(b) by 1037 days.

(21) Appl. No.: 12/962,915

(22) Filed: Dec. 8, 2010

(65) Prior Publication Data

US 2011/0131715 A1 Jun. 9, 2011

Related U.S. Application Data

(60) Provisional application No. 61/267,499, filed on Dec. 8, 2009, provisional application No. 61/294,648, filed on Jan. 13, 2010.

(51) Int. Cl.
*E03D 11/16* (2006.01)

(52) U.S. Cl.
CPC ..... *E03D 11/16* (2013.01)
USPC ..... 4/252.5; 4/252.4; 4/252.6

(58) Field of Classification Search
CPC ..... E03D 11/16
USPC ..... 4/252.1, 252.4–252.6, 679, 286, 288, 4/293
See application file for complete search history.

(56) References Cited

U.S. PATENT DOCUMENTS 842,363 A * 1/1907 Watrous ..... 285/58
938,533 A 11/1909 Wheeler
1,333,368 A * 3/1920 Auer ..... 4/252.5
1,533,444 A 4/1925 Mohr
2,190,532 A * 2/1940 Lukomski ..... 210/164
3,420,552 A * 1/1969 Mork ..... 285/42
4,306,738 A * 12/1981 Lindquist ..... 285/56
4,574,402 A * 3/1986 Brown, Sr. ..... 4/252.5
4,648,139 A 3/1987 Stokes
(Continued)

FOREIGN PATENT DOCUMENTS

CN 2780865 Y 5/2006
CN 2931606 Y 8/2007
(Continued)

OTHER PUBLICATIONS

Chinese Office Action dated Aug. 26, 2013.
(Continued)

*Primary Examiner* — Tuan N Nguyen
(74) *Attorney, Agent, or Firm* — Kramer Amado P.C.

(57) ABSTRACT

An improved method of installing a closet flange allows installation of plumbing fixtures with a reduced likelihood of leaks. The method involves telescopically fitting an inner or outer surface of a drainpipe to a surface of a cylindrical portion of a hub of a closet flange, where the hub has a base flange extending therefrom; and securing the base flange against the upper surface of a subfloor. A first layer of sealant is applied to an upper surface of the base flange; and a flooring membrane is secured to the upper surface of the base flange by the first layer of sealant. A second layer of sealant is applied to an upper surface of the flooring membrane; and the upper surface of the flooring membrane is clamped between the base flange and a clamping ring. The method may be performed using a two-part closet flange for connection to a drain pipe for a toilet. The two-part closet flange comprises a cylindrical hub adapted to telescopically connect to the drain pipe; an annular flange radially extending from the cylindrical hub; a clamping ring; and a means to clamp a flooring membrane between the clamping ring and the annular flange.

23 Claims, 11 Drawing Sheets

(56) References Cited

U.S. PATENT DOCUMENTS

| | | | | | |
|---|---|---|---|---|---|
| 4,886,302 | A | | 12/1989 | Forbes | |
| 5,246,255 | A | | 9/1993 | Forbes et al. | |
| 5,335,849 | A | | 8/1994 | Forbes | |
| 5,372,715 | A | * | 12/1994 | Maggard et al. | 4/288 |
| 5,492,372 | A | | 2/1996 | Dranberg | |
| 5,608,922 | A | | 3/1997 | Lewis | |
| 5,890,239 | A | | 4/1999 | Hite | |
| 6,065,160 | A | | 5/2000 | Winn | |
| 6,128,947 | A | * | 10/2000 | Anderson, Sr. | 73/46 |
| 6,155,606 | A | | 12/2000 | Phillips | |
| 7,069,603 | B2 | | 7/2006 | Flushing | |
| 7,458,109 | B1 | | 12/2008 | Kreisel | |
| 2004/0068783 | A1 | | 4/2004 | Rendell | |
| 2005/0050623 | A1 | | 3/2005 | Greene | |

FOREIGN PATENT DOCUMENTS

| | | | |
|---|---|---|---|
| JP | 63-181686 | U | 12/1988 |
| JP | 02229335 | | 9/1990 |
| JP | 417475 | | 2/1992 |
| JP | 2006037375 | | 2/2006 |
| JP | 2006249758 | A | 9/2006 |
| JP | 2011174336 | A | 9/2011 |
| KR | 20-1997-0023740 | | 6/1997 |
| KR | 127589 | | 6/1997 |
| WO | WO 2006/104861 | | 10/2006 |

OTHER PUBLICATIONS

International Search Report for PCT/US2010/059484 dated Aug. 19, 2011.

Written Opinion of the International Searching Authority for PCT/US2010/059484 dated Aug. 19, 2011.

Japanese Office Action for 2012-543249 dated Nov. 4, 2014.

* cited by examiner

WATER CLOSET FLANGE SEAL

CROSS-REFERENCE TO RELATED APPLICATIONS

This application claims the benefit of U.S. Provisional Application No. 61/166,412, filed on Dec. 8, 2009, and U.S. Provisional Application No. 61/294,648, filed on Jan. 13, 2010, the entire disclosures of which are incorporated herein by reference.

BACKGROUND

1. Field of the Invention

The present application relates to improved seals for water closets.

2. Description of Related Art

In plumbing, a closet flange is a pipe fitting (specifically, a type of flange) that both mounts a toilet to the floor and connects the toilet drain to a drain pipe. The name comes from the term "water closet", the traditional name for a toilet. A typical closet flange is composed of an ABS, PVC, or metal hub with a round steel mounting flange attached to the top. Other styles are made from copper, brass, stainless steel, or a plastic material.

In a typical installation, the closet flange is mounted on top of the floor with the hub fused around the drain pipe. A wax ring is used to seal the gap between the flange and the bottom of the toilet. The toilet is bolted to the flange, not to the floor. The existing art can allow water to leak from the wax ring at the discharge point of the toilet. In order to catch this water, it has been proposed in the prior art to provide an impermeable layer that rests above the finished flooring. The impermeable layer is sealed to the mounting flange of the closet flange.

However, such an impermeable layer is not sealed to the floor membrane. Water from a leaking or overflowing toilet, tub, or sink therefore can flow around the opening created for the plumbing and under the impermeable layer. This is a particular problem in a tiled floor, having recessed areas caused by grout lines. Grout lines under the impermeable layer can provide a pathway for water to travel to the opening in the floor for the toilet drain pipe, and hence to the floor below.

SUMMARY OF THE INVENTION

In light of the present need for improved watertight closet flanges, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Many tile floors have a membrane under the tile that holds water in the event that grout lines crack or leak. Leakage of water through the opening in the floor for the toilet drain pipe and closet flange may be prevented by integrating the membrane under a tile floor, or other impermeable layer of flooring, into or with the plumbing system. As described herein, this is done by sealing the flooring membrane at the penetration in the floor caused by a closet flange. Connections between a closet flange and a drainpipe as described herein may be done with a PVC, ABS, or cast iron pipe.

Various exemplary embodiments relate to a method of installing a closet flange by telescopically fitting an inner or outer surface of a drainpipe to a surface of a first cylindrical portion of a hub of a closet flange. The closet flange has a base flange extending from the hub. The base flange is secured against the upper surface of a subfloor. The next steps include applying a first layer of sealant to an upper surface of the base flange; securing a flooring membrane to the upper surface of the base flange by bonding the flooring membrane to the first layer of sealant; applying a second layer of sealant to an upper surface of the flooring membrane; and clamping the flooring membrane between the base flange and a clamping ring.

In certain embodiments of the closet flange disclosed herein, the base flange extending from the hub extends from said first cylindrical portion of said hub. In other embodiments, the base flange extending from the hub extends from a second cylindrical portion of said hub. The first and second cylindrical portions of the hub may be, but are not required to be, coaxial. In certain embodiments, the hub comprises a first cylindrical portion which telescopically connects to an inner or outer surface of a drainpipe; and a second cylindrical portion of the hub, where the base flange extends from the second cylindrical portion of the hub. In such embodiments, the second cylindrical portion is fluidly connected with the first cylindrical portion.

In various embodiments of the method disclosed herein, the step of clamping comprises positioning a clamping ring on the second layer of sealant; and securing the clamping ring to the subfloor. More particularly, the step of securing the clamping ring to the subfloor may comprise securing the clamping ring to the subfloor with a threaded fastener, such as a screw or a bolt, where the threaded fastener passes through the base flange between the clamping ring and the subfloor.

Alternative methods of securing the clamping ring to the subfloor include using a closet flange having a hub and a base flange extending from the hub. The hub comprises a first cylindrical portion below said base flange and a second cylindrical portion above said base flange, where the second cylindrical portion has an external surface with a first threaded joint. The clamping ring has an internal surface with a second threaded joint, where the second threaded joint is able to screw onto the first threaded joint. The step of clamping the flooring membrane between the base flange and the clamping ring comprises screwing the second threaded joint onto said first threaded joint until the clamping ring contacts the second layer of sealant.

In certain embodiments of the method disclosed herein, the step of securing the base flange of the closet flange against the upper surface of a subfloor includes applying a third layer of sealant to the subfloor; fitting a sealant dam to an inner peripheral edge of a lower surface of said base flange; and securing the base flange to the subfloor through said third layer of sealant.

Various exemplary embodiments relate to a method of fitting a closet flange to existing construction having a finished floor, where the closet flange has a hub with a base flange extending from the hub. This is done by fitting a sealant dam to an inner peripheral edge of a lower surface of the base flange; telescopically fitting an inner or outer surface of a drainpipe passing through a hole in the finished floor to a surface of a cylindrical portion of the cylindrical hub; applying a layer of sealant to an upper surface of a finished floor; and securing the base flange to the finished floor or flooring membrane through the layer of sealant. The sealant dam prevents sealant from entering the hole in the finished floor.

Various embodiments disclosed herein relate to a two-part closet flange for connection to a drain pipe for a toilet. The closet flange comprises a cylindrical hub, the cylindrical hub being adapted to telescopically connect to the drain pipe; an annular flange radially extending from the cylindrical hub; a clamping ring; and a means to clamp a flooring membrane between the clamping ring and the annular flange. Other embodiments relate to a two-part closet flange comprising a hub having a first cylindrical portion, where the first cylindrical portion is adapted to telescopically connect to the drain pipe; and a clamp assembly comprising:

a) an annular flange radially extending from said hub; and b) a clamping ring;

wherein the clamping ring and the annular flange are adapted to clamp a flooring membrane between the clamping ring and the annular flange.

Further embodiments relate to a two-part closet flange seal for connection to a drain pipe for a toilet, comprising a cylindrical hub, the cylindrical hub being adapted to telescopically connect to the drain pipe; an annular flange radially extending from the cylindrical hub; a clamping ring; and a means to clamp a flooring membrane between the clamping ring and the annular flange; wherein the means to clamp comprises at least one threaded fastener securing the clamping ring and the annular flange to a subfloor.

Additional embodiments relate to a two-part closet flange for connection to a drain pipe for a toilet, comprising a cylindrical hub, the cylindrical hub being adapted to telescopically connect to the drain pipe; an annular flange radially extending from the cylindrical hub; a clamping ring; and a means to clamp a flooring membrane between the clamping ring and the annular flange; wherein the means to clamp comprises a first threaded surface on an interior surface of the clamping ring; an annular flange radially extending from a lower edge of the clamping ring; and a second threaded surface on an exterior surface of the cylindrical hub, the second threaded surface extending above the annular flange radially extending from the cylindrical hub. The first threaded surface is adapted to screw onto the second threaded surface so as to clamp a flooring membrane between the annular flange extending from the clamping ring and the annular flange extending from the cylindrical hub.

BRIEF DESCRIPTION OF THE DRAWINGS

In order to better understand various exemplary embodiments, reference is made to the accompanying drawings, wherein.

DETAILED DESCRIPTION

Figure 1:
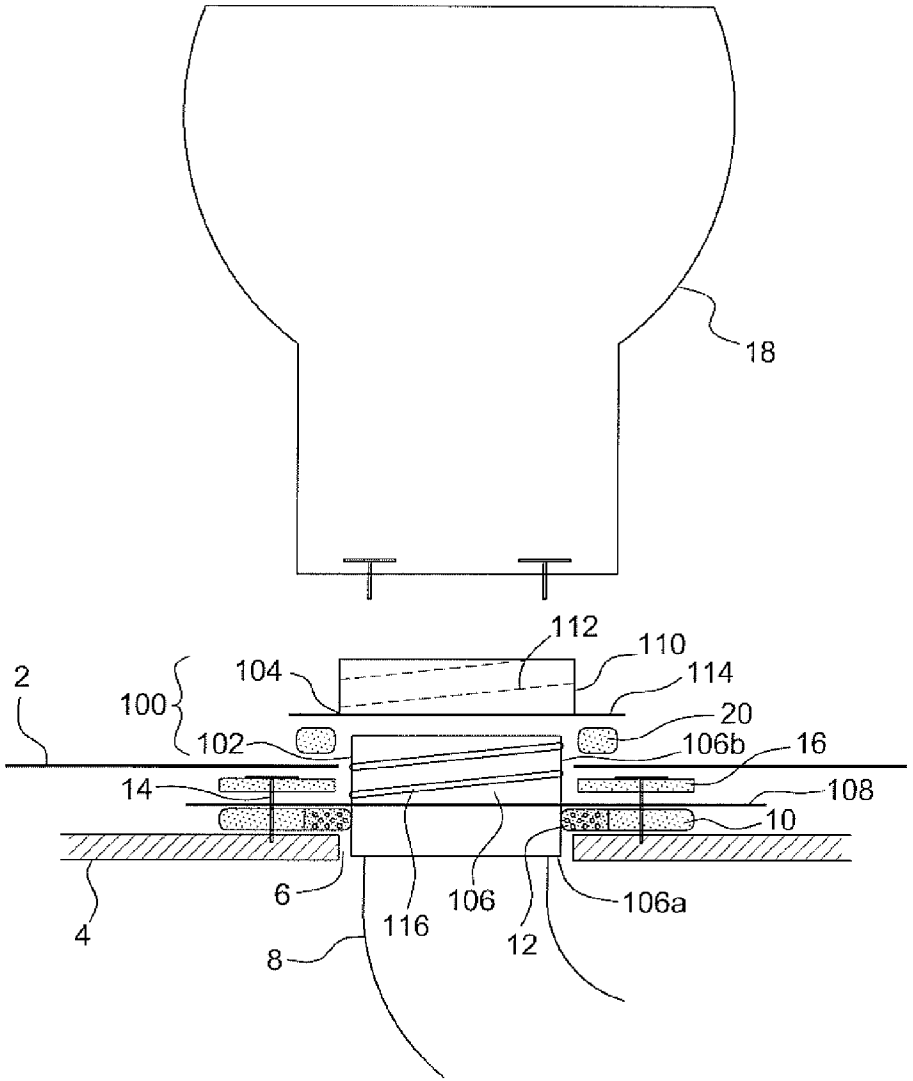
FIG. 1 shows an exploded view of a first embodiment of a two-part closet flange seal and its use in installation of a toilet.

Referring now to the drawings, in which like numerals refer to like components or steps, there are disclosed broad aspects of various exemplary embodiments.

As seen in FIG. 1, an improved seal between a floor and a closet flange may be accomplished with a two-part closet flange 100, comprising a base portion 102 and a clamping ring 104. An impermeable floor covering 2, such as an impermeable sheet or template, is placed directly over the subfloor, decking, or floor base 4, where the subfloor, decking, or floor base 4 may be made of wood, metal, or concrete. In new construction, the impermeable floor covering 2 is adhered to the base portion 102 of the closet flange 100. The base portion 102 of closet flange 100 has a hub 106 and an annular base flange 108 extending from the hub. The hub 106 is placed through a hole 6 in the subfloor 4, allowing a toilet drain pipe 8 to extend through hole 6 in subfloor 4. The inner surface of a lower cylindrical portion 106*a* of hub 106 is adhesively bonded or fused to the outer surface of the drain pipe 8. A circular layer of sealant 10 is applied to the lower surface of the annular base flange 108 of the closet flange 100. Preferably, a sealant dam 12 is positioned against the inner edge of the annular base flange 108 of the closet flange 100. The circular layer of sealant 10 is pressed against the subfloor 4, and the base portion 102 of the closet flange is bolted to the subfloor 4, preferably with bolts 14 that pass through the layer of sealant 10, as seen in FIG. 1. The sealant dam 12, if present, prevents sealant between the subfloor 2 and the annular flange 108 from leaking through the hole 6 in the subfloor 2.

A second layer of sealant 16 is then applied to the upper surface of the annular flange 108 of the closet flange 100. The impermeable flooring membrane 2 is then fastened to the second layer of sealant 16. The impermeable flooring membrane 2 has a hole therethrough to allow connection between a drain of toilet 18 and the drain line. A third circular layer of a sealant 20 is then placed over the impermeable flooring membrane 2 around the hole through the impermeable sheet 2. The impermeable sheet or membrane 2 is secured by cylindrical clamping ring 104 which fits over an upper cylindrical portion 106*b* of the cylindrical hub 106.

In certain embodiments, the base flange 108 extends radially from either the lower cylindrical portion 106*a* of the hub 106, or from the upper cylindrical portion 106*b* of the hub. The upper and lower cylindrical portions of the hub may be coaxial, but are not required to be coaxial. In certain embodiments, the upper and lower cylindrical portions of the hub may be separated by an intermediate portion which is curved or bent so that the axis of the first cylindrical portion and the axis of the second cylindrical portion meet at an angle. In other embodiments, the upper and lower cylindrical portions of the hub may be separated by an S-shaped curved portion so that the upper and lower cylindrical portions are parallel to each other, but offset from each other.

In certain embodiments in accordance with FIG. 1, the base flange 108 extends radially from the upper cylindrical portion 106*b* of the hub. The clamping ring 104 may be a cylindrical ring or tube 110 with a threaded inner surface 112 and an annular flange 114 extending from the lower end of the threaded cylindrical ring or tube 110. In such embodiments, the threaded inner surface of the cylindrical tube is screwed onto a threaded outer surface 116 of at least the upper portion 106*b* of the cylindrical hub 106 of the closet flange 100 until the flange 114 of the clamping ring 104 contacts the third circular layer of sealant 20. The impermeable sheet 2 is then secured between the lower annular flange 108 and the upper clamping ring 104. The toilet 18 is then bolted to the closet flange 100.

The circular layer of sealant 20 between the impermeable flooring membrane 2, such as a flooring cap sheet or tile membrane, and the clamping ring 104 of the closet flange 100 prevents water flowing over the impermeable layer 2 from traveling through the hole in the impermeable layer 2 and under the impermeable layer 2. The circular layer of sealant 16 between the impermeable flooring membrane 2, such as a flooring cap sheet or tile membrane, and the annular flange 108 of the closet flange 100 also prevents water which might penetrate a puncture in the impermeable layer 2 and flow under the impermeable layer 2 from reaching the hole 6 for the drainpipe 8 in the subfloor 4. Thus, water cannot reach the hole for the toilet drain line, and leakage of water around the drain line is prevented.

Figure 3:
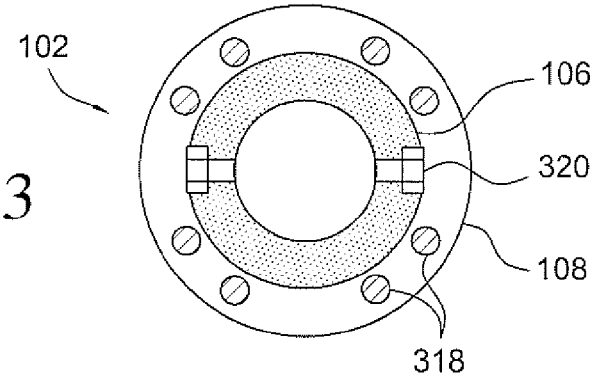
FIGS. 3 and 3A show an embodiment of a base portion of a closet flange for use in an embodiment of FIG. 2.
Figure 3A:
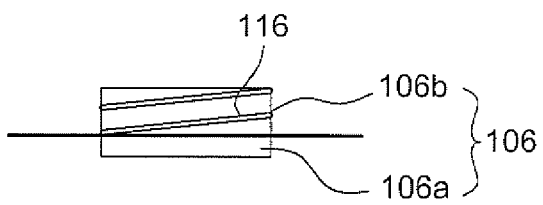
Figure 6:
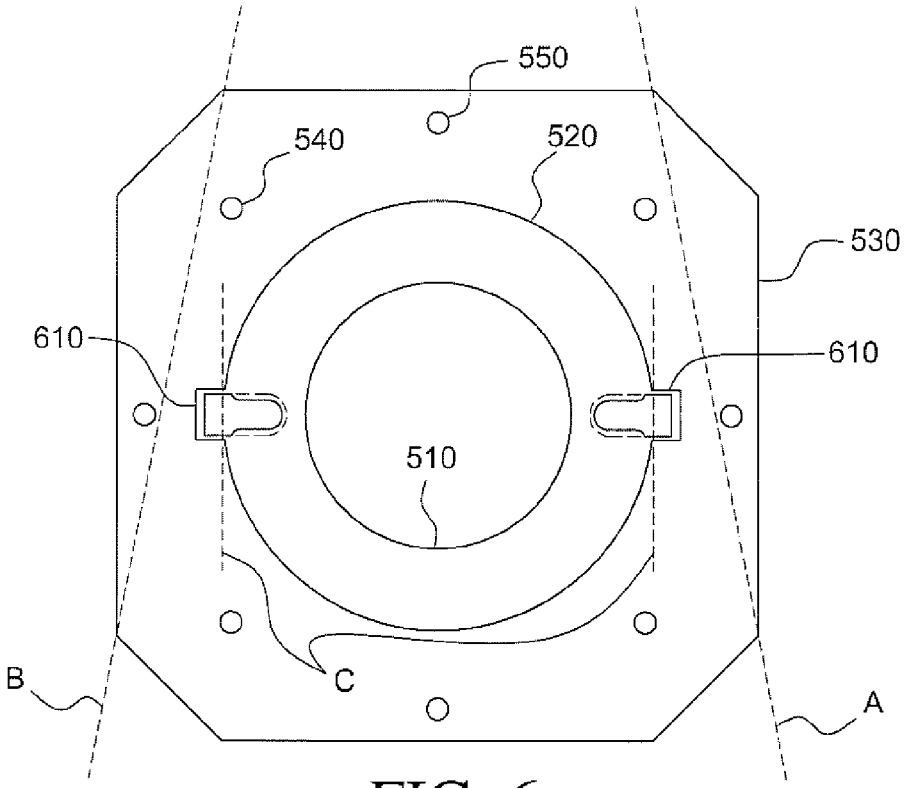

The base portion 102 of the closet flange 100 is seen in more detail in FIG. 3 and FIG. 3A. In certain embodiments, base portion 102 of the closet flange 100 has a cylindrical hub 106 with an annular flange 108 extending perpendicularly from the hub. In certain embodiments, hub 106 includes an upper portion 106*b* extending above the flange 108, and a lower portion 106*a* extending below the flange 108, as seen in FIG. 3A. Above the flange 108, the outer surface 116 of the upper portion 106*b* of hub 106 is threaded. The annular flange 108 may be circular, as seen in FIG. 3, or substantially quadrilateral, i.e., square, as seen in FIG. 6. Bolt-receiving holes 318 may be formed in annular flange 108. Notches 320 to receive the heads of upwardly-directed bolts may be formed in the hub 106 of the base portion 102.

Figure 4:
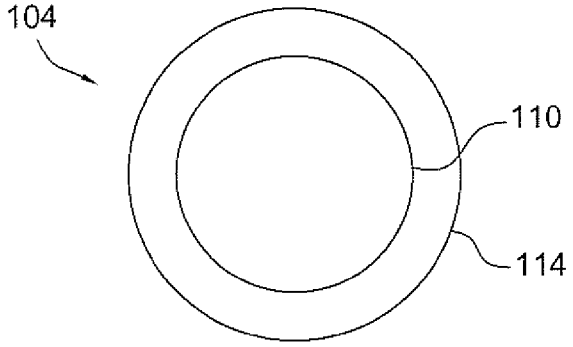
FIGS. 4 and 4A show an embodiment of a clamping ring for use in an embodiment of FIG. 2.
Figure 4A:
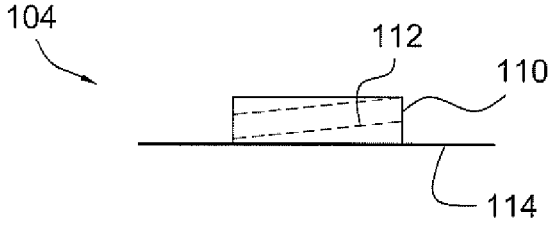

The base portion 102 seen in FIG. 3 is used in a two-part closet flange 100 which also includes a clamping ring 104 as seen in FIG. 4 and FIG. 4A. The clamping ring 104 includes a cylindrical ring 110 with a threaded inner surface 112, and an annular flange 114 extending therefrom.

Figure 2:
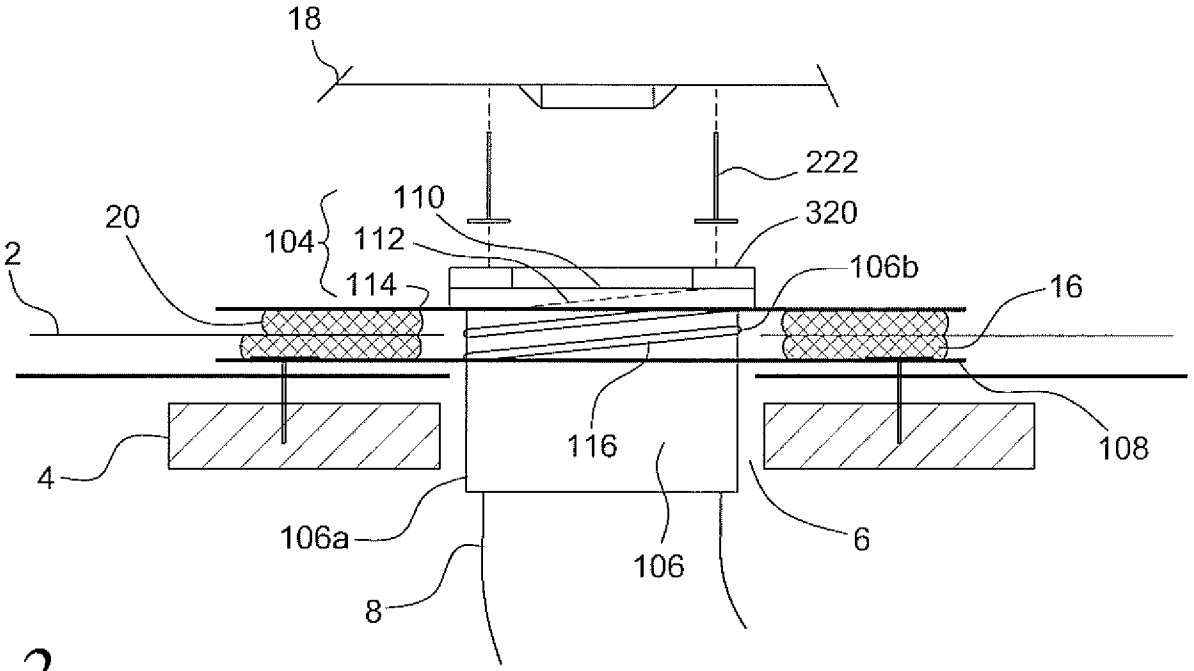
FIG. 2 shows an exploded view of a second embodiment of a two-part closet flange seal and its use in installation of a toilet.

An alternate view of a closet flange seal made using the closet flange base portion of FIG. 3 and the clamping ring of FIG. 4 is shown in FIG. 2. A drain pipe 8 for a toilet passes through a hole 6 in a subfloor 4. In certain embodiments, the outer surface of the drainpipe 8 is sealed to the inner surface of a cylindrical lower portion 106*a* of hub 106 of the closet flange, as seen in FIG. 2. In other embodiments, the inner surface of the drainpipe 8 is sealed to the outer surface of a hub 106 of the closet flange seal. The seal may be made by means of adhesively bonding or fusing the hub to the drainpipe, or by means of a gasket on the surface of the closet flange which seals to the surface of the drainpipe. A base flange 108 extends from the hub 106 of the closet flange 100, perpendicularly to the axis of the closet flange 100. This base flange 108 is positioned against the upper surface of the subfloor 4, and bolted into place. A layer of sealant 16 is applied to the upper surface of the base flange 108. The flooring membrane 2 is then secured to the upper surface of the base flange 108 by the sealant 16. A second layer of sealant 20 is then applied to the upper surface of the flooring membrane 2. The hub 106 of the closet flange extends above the base flange, forming an upper portion 106*b* with a threaded outer surface.

The clamping ring 104 with a tube or ring 110 having a threaded inner surface 112 is then screwed onto the threaded portion of the hub, until the annular flange 114 of the clamping ring 104 contacts the second layer of sealant 20 on the upper surface of the flooring membrane 2. Preferably, when clamping ring 104 is screwed into place, bolt-receiving notches 320 are exposed above the upper edge of tube or ring 110, as seen in FIG. 2. Bolts 222 may then be positioned in bolt receiving notches 320, and toilet 18 may be positioned on bolts 222. If water is subsequently spilled on the flooring membrane 2, it will then flow over the flooring membrane 2 and base flange 108 until it contacts the second sealant layer 20, and then around the space defined by the sealant layer. Water will not flow under or through the base flange or through the hole in the subfloor.

Figure 5:
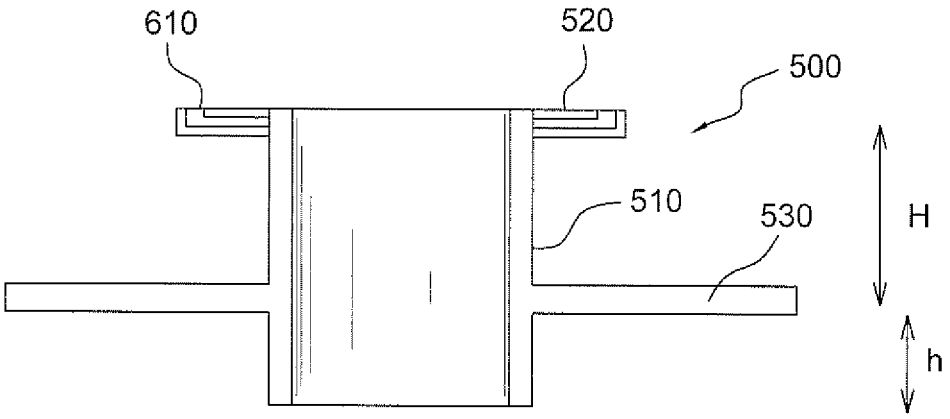
FIGS. 5 and 6 show two views of an embodiment of a mounting ring assembly.

Further embodiments of the invention make use of a mounting ring assembly 500, seen in FIGS. 5 and 6. The mounting ring assembly 500 has a tubular member 510 having a predetermined height which is generally from 0.5 to 2.5 inches. It has a top end, a bottom end, and an annular flange 520 extending radially outwardly from the top end of the tubular member 510. A base plate 530 also extends perpendicularly from the outer surface of tubular member 510 and it is located a predetermined height above the bottom end of the tubular member 510. In certain embodiments, the bottom surface of the base plate 530 is from 0.25 to 1.5 inches from the top surface of the annular flange 520; this distance is designated by the letter H. The distance between the bottom surface of the base plate and the bottom end of the tubular member is designated by the letter h. The plate 3 has four bolt-receiving holes 540 at the corners of the substantially square base plate, and bolt receiving holes 550 at the front and rear edges, as seen in FIG. 6.

The top surface of the annular flange has a plurality of open ended slot assemblies 610 extending radially therefrom. In general, the mounting ring assembly 500 is designed to be placed in an aperture that has been cut in a subfloor, which may be made from corrugated steel, concrete, or wood, so that the bottom end of tubular member 510 telescopically fits with a drain pipe passing through the subfloor. A concrete floor is then poured over the subfloor until the top surface of the concrete floor is level with the upper end of the mounting ring assembly 500, burying the base plate 530 of the mounting ring assembly 500. The base of a toilet bowl is secured to the top surface of the annular flange 520 by a plurality of bolts extending upwardly from the open ended slot assemblies 610, each bolt having a shank portion and a head portion. Nuts are used to tighten the base of the toilet bowl in position.

Figure 7:
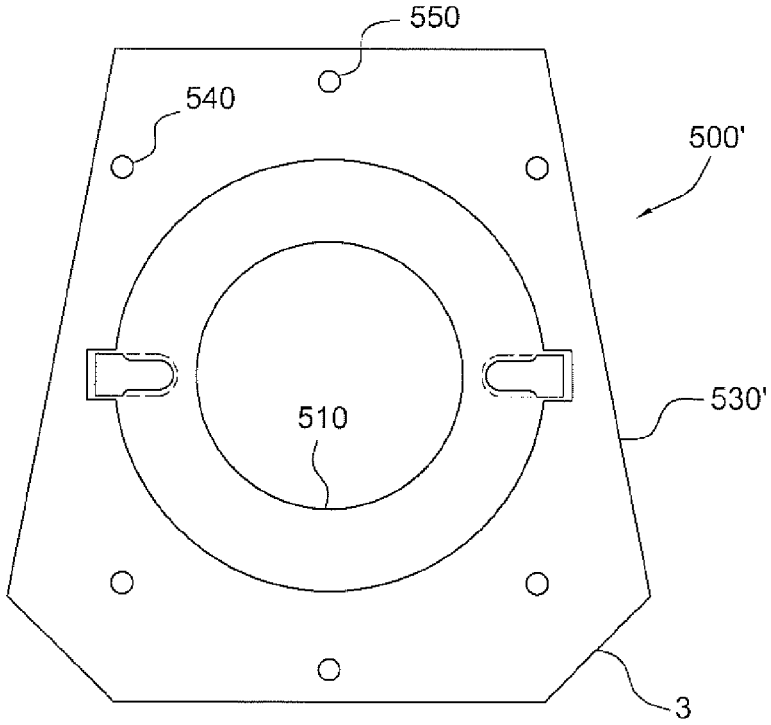
FIG. 7 shows a view of an alternate embodiment of a mounting ring assembly.
Figure 9:
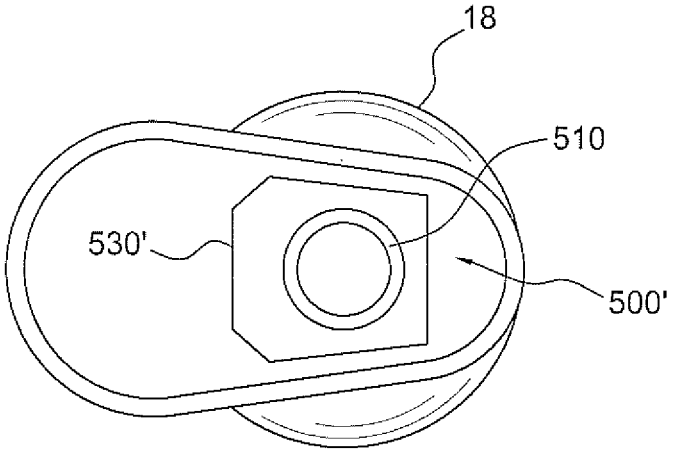
FIG. 9 shows installation of the alternate embodiment of a mounting ring assembly seen in FIG. 7 in the base of a toilet.
Figure 11A:
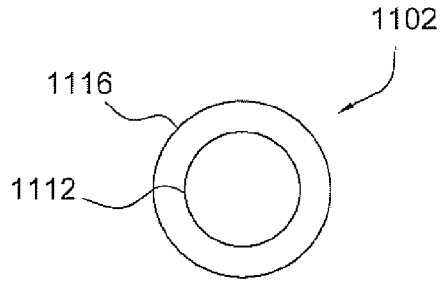
FIGS. 11, 11A, 11B, and 11C show an alternate embodiment of a base flange and an embodiment of a clamping ring for use in an embodiment of FIG. 2.
Figure 11:
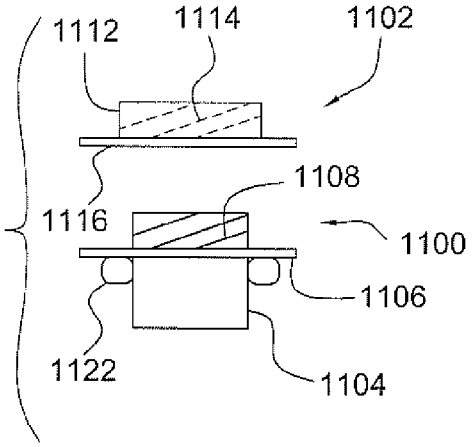

The flange 500 may be modified to produce a flange 500' for use in the current application by reshaping the substantially square base plate 530 of a flange 500 so that it is a substantially quadrilateral base plate 530', as shown in FIG. 7. This may be done by cutting the base plate 530 along lines A and B, as shown in FIG. 6, to produce quadrilateral base plate 530', as shown in FIG. 7. If desired, the ends of open ended slot assemblies 610 may be made flush with the outer edge of annular flange 520 by cutting along lines C, tangential to flange 520, as shown in FIG. 6. Unlike the flange 500, the flange 500' as modified for use in the current application is designed so that the quadrilateral base plate 530' fits directly into the bottom of the toilet 18, as shown in FIG. 9, rather than being, positioned under a concrete layer. The shape of the substantially quadrilateral base plate 530' may be designed to match the shape of the toilet 18. If the sides of the base of the toilet 18 taper in a direction from a wide rear end to a narrow front end, the substantially quadrilateral base plate 530' may be an Isosceles trapezoid, as seen in FIG. 7. If the sides of the base of the toilet are substantially parallel, the substantially quadrilateral base plate 530' may be rectangular, as seen in FIG. 11. Although the description provided has described the shape of the base plate in terms of modifying an existing base plate, the base plate 530' may be provided by molding a flange having the desired shape directly, without modifying an existing article.

Figure 10:
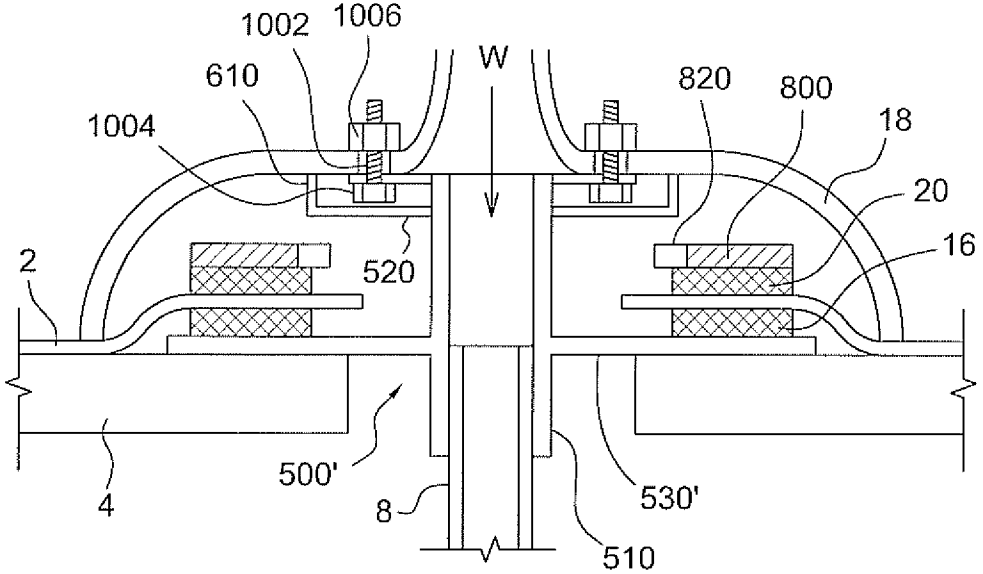
FIG. 10 shows connection of a toilet to a drainpipe using a mounting ring assembly seen in FIG. 7.

The substantially quadrilateral base plate 530' of the modified flange 500' is positioned on a wood, steel, or concrete subfloor 4, with the bottom end of the tubular member 510 extending into a hole 6 for a toilet drainpipe 8, as shown in FIG. 10. The outer surface of the drainpipe 8 is sealed to the inner surface of the bottom end of the tubular member 510 of the modified flange 500'. Substantially quadrilateral base plate 530' extends from the hub or tubular member 510 of the closet flange 500', perpendicularly to the axis of the closet flange 500', and is positioned against the upper surface of the subfloor 4, and bolted into place (bolts not shown for reasons of clarity). A layer of sealant 16 is applied to the upper surface of the quadrilateral plate 530'. A flooring membrane 2 is then secured to the upper surface of the substantially quadrilateral base plate 530' by the sealant 16.

As seen in FIG. 10, a second circular layer of sealant 20 is then applied to the upper surface of the flooring membrane 2 over the quadrilateral plate 530'. The tubular hub 510 of the modified flange 500' extends above the quadrilateral plate 530'. A clamping ring 800 is then positioned around tubular hub 510 over the second layer of sealant 20 on the flooring membrane 2.

Figure 8:
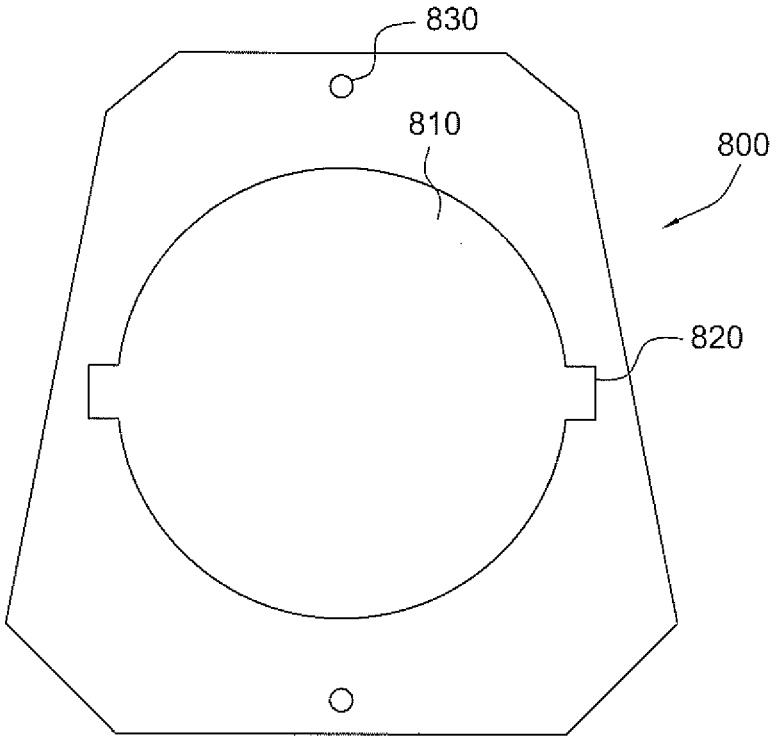
FIG. 8 shows a clamping ring for use with the alternate embodiment of a mounting ring assembly seen in FIG. 7.

Referring now to FIG. 8, the clamping ring 800 may have a substantially quadrilateral shape, which may match the shape of base plate 530'; alternatively, clamping ring 800 may have a circular shape. The clamping ring 800 has a hole 810 through the entire thickness of ring 800 to accommodate the tubular member 510 of modified flange 500'. The inner edge of the clamping ring 800 may have cutout notches 820 designed to accommodate the radially extending open ended slot assemblies 610 on the upper surface of the annular flange 520 extending perpendicularly from the top end of the tubular member 510. In certain embodiments, the ends of open ended slot assemblies 610 have been made flush with the outer edge of annular flange 520 of flange 500', as discussed above with regard to FIG. 6; in such a case, cutout notches 820 in clamping ring 800 are unnecessary. Bolt-receiving holes 830 in clamping ring 800 are positioned so as to coincide with bolt-receiving holes 550 at in modified flange 500'.

Returning to FIG. 10, the clamping ring 800 is positioned over the quadrilateral base plate 530' extending from the tubular member 510 so that the clamping ring 800 contacts the second layer of sealant 20 on the upper surface of the flooring membrane 2. If open ended slot assemblies 610 are present on annular flange 520, clamping ring 800 may have cutout notches 820 designed to accommodate the radially extending open ended slot assemblies 610. If open ended slot assemblies 610 are absent on annular flange 520, or have ends which are flush with the edge of annular flange 520, cutout notches 820 are not required on clamping ring 800. The clamping ring 800 is then bolted to the subfloor 4 by driving bolts through holes 830 in the clamping ring and through corresponding holes 550 in the quadrilateral base plate 530' of the modified flange 500' into the wood, steel or concrete subfloor 4.

A toilet 18 is then positioned over the modified flange 500' so that the outlet of the toilet (not shown in FIG. 10) fits telescopically into the tubular member 510 of the modified flange 500' and the substantially quadrilateral base plate 530' of the flange 500' fits into the bottom of the toilet 18. This allows water to flow from the toilet to drain pipe 8 in the direction of arrow W, as seen in FIG. 10. The toilet 18 may be positioned over the flange 500' by driving bolts through holes in the base of the toilet and through corresponding holes in the clamping ring and the quadrilateral base plate of the modified flange into the concrete subfloor. Alternatively, heads 1004 of upwardly directed bolts 1002 may be positioned in the radially extending open ended slot assemblies 610 on the upper surface of the annular flange 520 of the modified flange 500', as seen in FIG. 10. The toilet 18 is then positioned over the modified flange 500' so that the outlet of the toilet fits telescopically into the tubular member 510 of the modified flange 500' and the upwardly directed bolts 1002 extending from the radially extending open ended slot assemblies 610 fit through holes in the base of the toilet 18. The substantially quadrilateral base plate 530' of the flange 500' also fits into the bottom of the toilet 18 so that the edges of the base of the toilet fit flush against the subfloor 4. Nuts 1006 may then be screwed onto the upwardly extending bolts 1002 to fit the toilet securely in position.

Figure 11B:
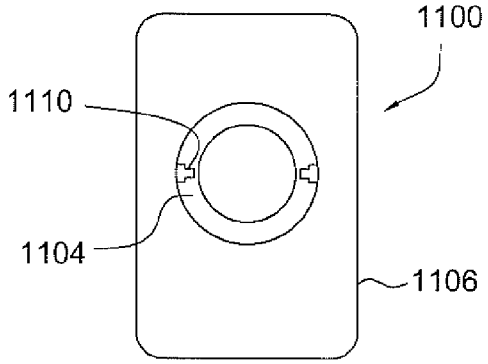
Figure 11C:
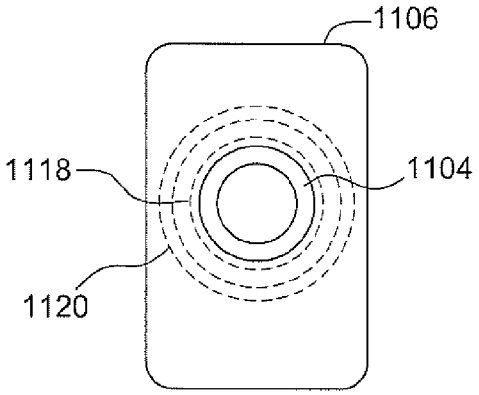

FIG. 11 shows a further embodiment of the closet flange of the current invention, including a base flange 1100 and a clamping ring 1102. The base flange 1100 has a cylindrical hub 1104 with an annular flange 1106 extending perpendicularly from the hub 1104, as seen in FIG. 11 from the side and FIG. 11B from above. In certain embodiments, the cylindrical hub 1104 has an inner diameter such that the cylindrical hub may slide telescopically over a drain pipe, where the drain pipe has an outer diameter of, for example, 3 inches or 4 inches. In certain embodiments, the cylindrical hub 1104 has an outer diameter such that the cylindrical hub may slide telescopically into a drain pipe, which may be, for example, 3-inch diameter pipe or 4-inch diameter pipe. In certain embodiments, the cylindrical hub may be connected to either 3-inch diameter pipe or 4-inch diameter pipe; in such embodiments, the cylindrical hub 1104 has an outer diameter such that the cylindrical hub may slide telescopically into 4-inch diameter pipe; and an inner diameter such that the cylindrical hub may slide telescopically over 3-inch diameter pipe. Above the flange 1106, the outer surface of the hub 1104 includes threading 1108. Notches 1110 to receive the heads of upwardly-directed bolts may be formed in the hub 1104 of the base flange 1100, as seen in FIG. 11B. The annular flange 1106 may be substantially quadrilateral, shaped to fit into the base of the toilet. In the embodiment of FIG. 11B, the annular flange 1106 is substantially rectangular. The clamping ring 1102 includes a cylindrical ring 1112 with threading 1114 on its inner surface, and an annular flange 1116 extending outwardly from a lower edge of ring 1112, as shown in FIGS. 11 and 11A. The threaded inner surface of the clamping ring 1102 may be screwed onto the threaded outer surface of the hub 1104 of the base flange 1100. As seen in the view from below in FIG. 11C, the base flange 1100 may have two annular recesses 1118 and 1120 on the lower surface. An inner annular recess is 1118 is positioned adjacent to or in proximity to the hub 1104, and is designed to receive a closed cell foam gasket 1122, as seen in FIG. 11, or an elastomeric gasket. An outer annular recess 1120 is designed to receive a layer of sealant.

Figure 12:
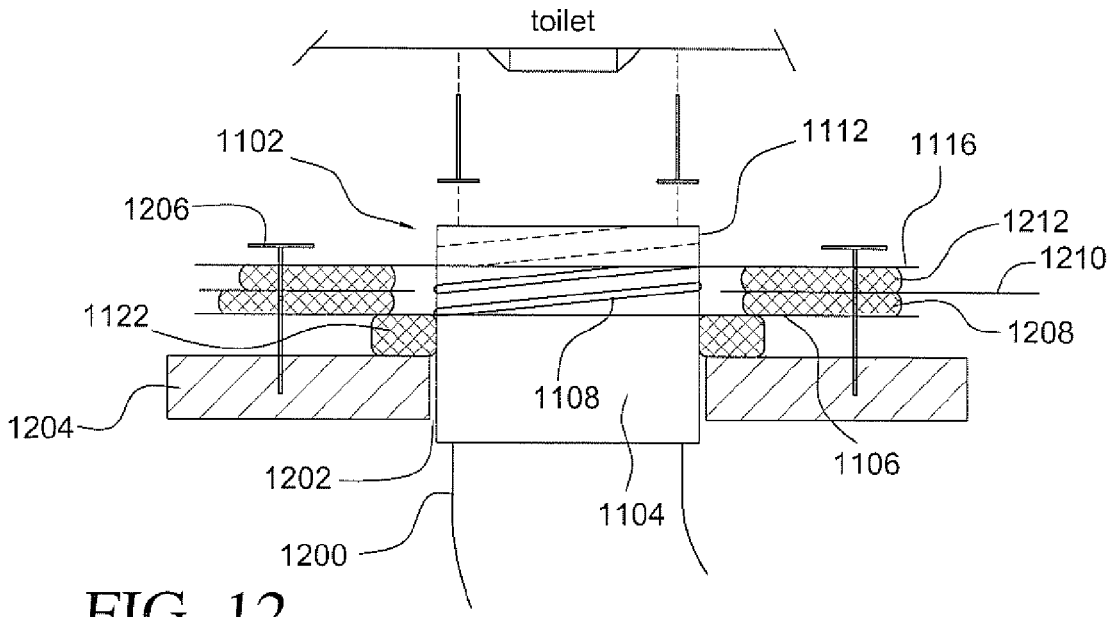
FIG. 12 shows a view of an embodiment of a two-part closet flange seal and its use in installation of a toilet in new construction.

FIG. 12 shows use of the closet flange of FIG. 11 in new construction. A drain pipe 1200 for a toilet passes through a hole in a subfloor 1204. The outer surface of the drainpipe is sealed to the inner surface of the hub 1104 of the closet flange 1100. The annular flange 1106 of the base flange 1100 of the closet flange is positioned against the upper surface of the subfloor 1204, and bolted into place with bolts 1206. The inner annular recess 1118 (not shown in FIG. 12) of the annular flange 1106 of base flange 1100 contains a closed cell foam gasket 1122 or an elastomeric gasket which is pressed against the subfloor as a sealant dam. A layer of sealant 1208 is applied to the upper surface of the annular flange 1106. The flooring membrane 1210 is then secured to the upper surface of the annular flange 1106 by the sealant 1208. In the event sealant leaks under the annular flange 1106, the sealant dam 1122 prevents it from leaking through the hole 1202 in the subfloor 1204.

A second layer of sealant 1212 is then applied to the upper surface of the flooring membrane 1210. The threaded cylindrical ring 1112 of the clamping ring 1102 is then screwed onto the threading 1108 on the hub 1104, until the annular flange 1116 of the clamping ring 1102 contacts the second layer of sealant 1212 on the upper surface of the flooring membrane 1210. If water is subsequently spilled on the flooring membrane, it will then flow over the base flange until it contacts the second sealant layer, and then around the space defined by the sealant layer. Water will not flow under or through the base flange or through the hole in the subfloor.

Figure 13:
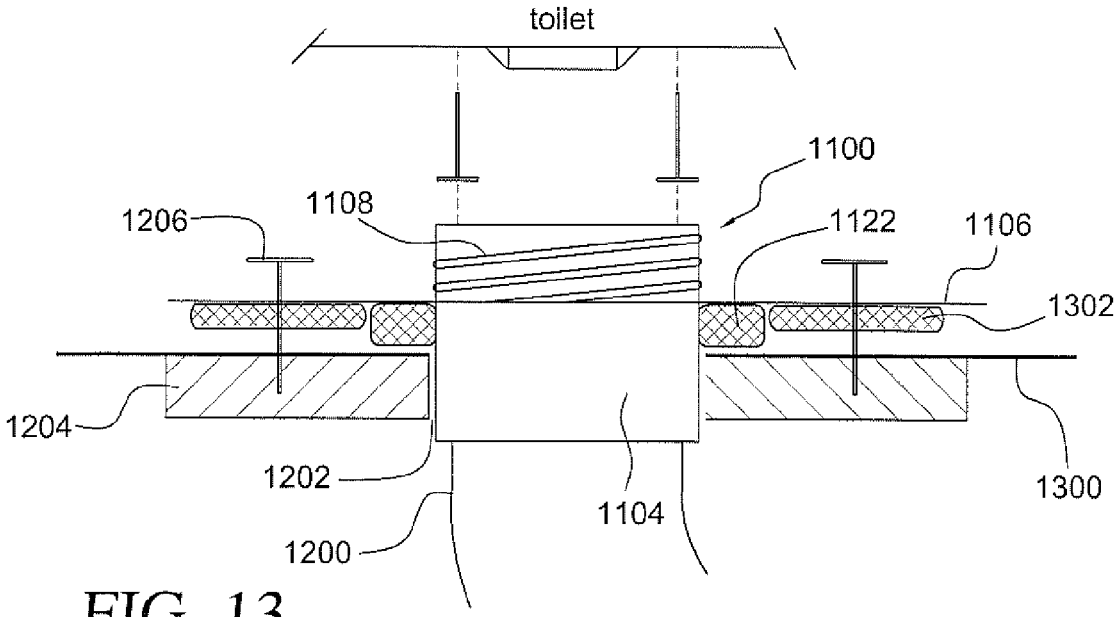
FIG. 13 shows a view of an embodiment of a closet flange seal and its use in installation of a toilet in existing construction using a sealant dam.

FIG. 13 shows retrofitting of the closet flange of FIG. 11 to existing construction having a finished floor 1300 on top of a subfloor 1204. A drain pipe 1200 for a toilet passes through a hole 1202 in a subfloor 1204. A closet flange including a base flange 1100 with a cylindrical hub 1104 fits onto the existing drain pipe by sliding telescopically over the existing drainpipe or into the existing drainpipe, depending on drainpipe diameter. The annular flange 1106 of the base flange 1100 of the closet flange is positioned against the upper surface of the finished floor 1300, and bolted into place with bolts 1206. The annular flange 1106 contains two annular recesses on its lower surface (not shown in FIG. 13). The inner annular recess 1118 of the annular flange 1106 of base flange 1100 contains a closed cell foam gasket 1122 or an elastomeric gasket which is pressed against the floor as a sealant dam. The sealant dam may also be made of wax. The outer annular recess 1120 of the annular flange 1106 of base flange 1100 contains a sealant layer 1302 which is pressed against the floor 1300; the sealant dam 1122 prevents sealant from entering the hole 1202 in the subfloor 1204. The threaded cylindrical ring of the clamping ring 1102 (not shown in FIG. 13) may then be screwed onto the threaded portion of the hub, until the annular flange of the clamping ring contacts the base flange; however, it is not required for a retrofit installation. However, if new flooring is ever installed, the clamping ring 1102 may be used to clamp the new flooring against the base flange. Therefore, screwing the clamping ring 1102 onto the hub 1104 and saving it for future use is advisable.

Figure 14:
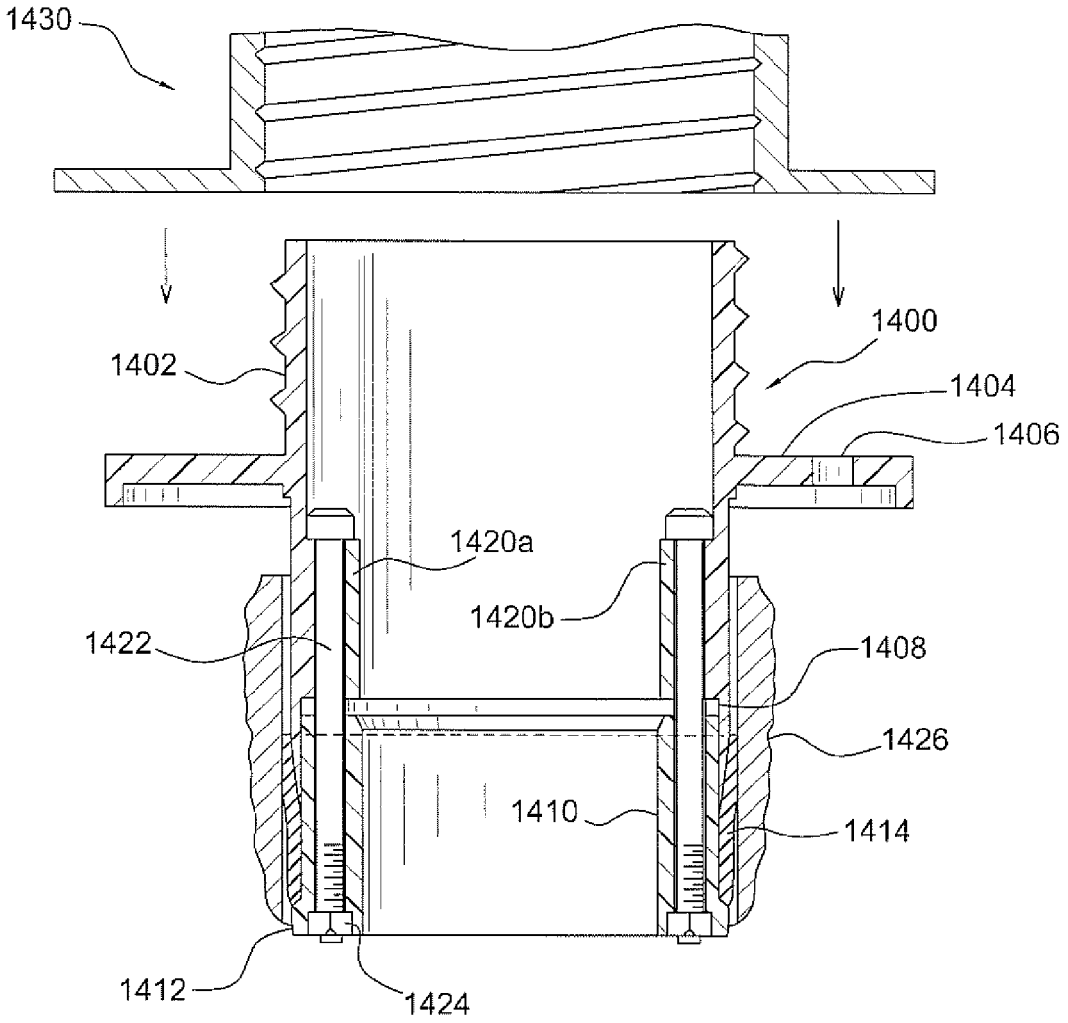
FIG. 14 shows a view of an embodiment of a closet flange seal having an elastomeric seal for connection to pipes.

FIG. 14 shows an alternate compression closet flange for installation on top of a drain pipe. This may be done in either new construction, or in a retrofit assembly. The closet flange includes a base flange 1400 having an optionally threaded upper portion with cylindrical hub 1402, and an annular flange 1404 extending radially outward from the cylindrical hub 1402 midway between the upper and lower ends of the cylindrical hub 1402. The annular flange 1404 has openings 1406 therein for receiving bolts. A lower end of the cylindrical hub 1402 has a recessed area 1408 for receiving an upper end of a lower section 1410 which fits telescopically inside the cylindrical hub. A lower end of the lower section 1410 has a lip 1412 for seating a cylindrical seal 1414, the lip having an outer diameter. The outer diameter of the lip is substantially the same as the outside diameter of the cylindrical hub 1402.

The annular flange 1404 has, on its lower surface, at least one and preferably two annular recesses 1416. Each annular recess 1416 is adapted to contain a sealant darn or a layer of sealant to be pressed against a floor surface. In some embodiments, the annular flange 1416 contains an inner annular recess and an outer annular recess. The inner annular recess of the annular flange contains a closed cell foam gasket or an elastomeric gasket which is pressed against the floor as a sealant dam. The outer annular recess of the annular flange contains a sealant layer which is pressed against the floor; the sealant dam prevents sealant from entering the hole in the subfloor.

Cylindrical bores 1420*a* and 1420*b* run through the cylindrical hub 1402 and through a wall of the lower section 1410. Bolts 1422 run through these cylindrical bores and through nonrotatable nuts 1424 in the lower section, so that the heads of the bolts may be accessed from the upper end of the cylindrical hub 1402 and tightened. After positioning the cylindrical hub telescopically inside a drainpipe 1426, tightening these bolts 1422 draws the lower section 1410 upward toward the cylindrical hub 1402.

The cylindrical seal 1414 is seated between the cylindrical hub 1402 and the lower section 1410. The cylindrical seal is made of rubber or another elastomer. As the lower section is drawn upward toward the cylindrical hub, the cylindrical seal 1414 is compressed and expands outwardly toward the inner surface of the drainpipe 1426, thereby providing a compression fit between the cylindrical seal 1414 and the inside of the drainpipe 1426. In new construction, a flooring membrane may then be positioned over flange 220, and a clamping ring 1430 may then be screwed or bolted onto the upper portion of the cylindrical hub to clamp the flooring membrane between flange 1404 and the clamping ring 1430.

In certain embodiments, the cylindrical seal is seated between the cylindrical hub and the lower section, and is facing an inner surface of the cylindrical hub and the lower section. In such embodiments, the inner surface of the cylindrical hub fits telescopically over the outer surface of the drainpipe. As the lower section is drawn upward toward the cylindrical hub, the cylindrical seal is compressed and expands inwardly toward the outer surface of the drainpipe, thereby providing a compression fit between the cylindrical seal and the outside of the drainpipe.

In other embodiments, a first cylindrical seal is seated between the cylindrical hub and the lower section, and is facing an inner surface of the cylindrical hub and the lower section; and a second cylindrical seal is seated between the cylindrical hub and the lower section, and is facing an outer surface of the cylindrical hub and the lower section. As the lower section is drawn upward toward the cylindrical hub, both cylindrical seals are compressed and expand. In such embodiments, the user may elect to fit the inner surface of the cylindrical hub telescopically over the outer surface of the drainpipe; or to fit the outer surface of the cylindrical hub telescopically over the inner surface of the drainpipe.

Figure 15:
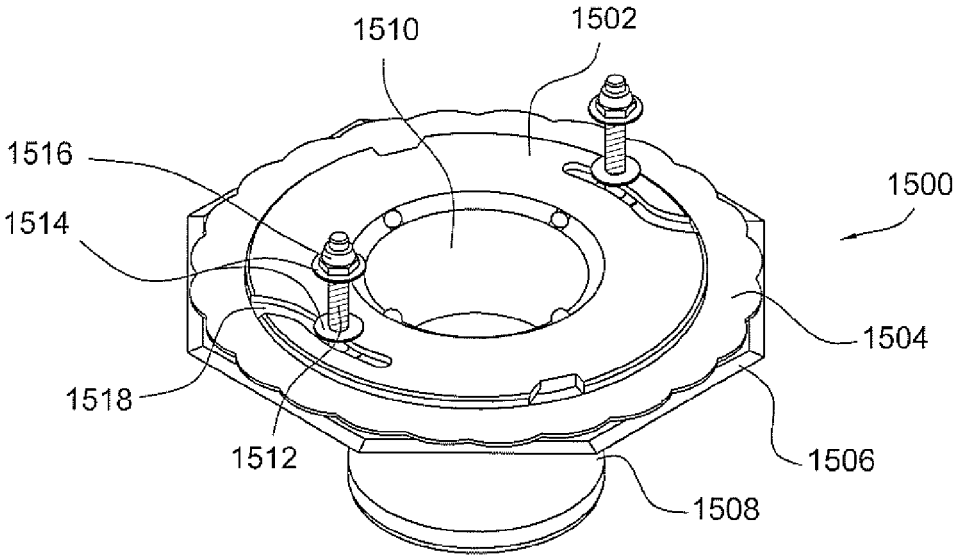
FIG. 15 shows an alternate embodiment of a two-part closet flange seal.

As seen in FIG. 15, various embodiments of the invention use a two-part closet flange 1500 to provide an improved seal between a floor and a closet flange. Flange 1500 comprises a base portion with a hub portion 1508 and a annular base flange 1506 extending from the hub; and a clamping ring 1502. An impermeable floor covering 1504 may be positioned between base flange 1506 and clamping ring 1502. A cylindrical portion 1510 of clamping ring 1502 extends telescopically into hub portion 1508 of flange 1500.

The upper surface of annular base flange 1506 comprises at least two notches 1518 adapted to receive the heads of bolts 1512. Notches 1518 may be radially directed straight notches, or curved notches as shown in FIG. 15. Bolts 1512 are used to secure a toilet to flange 1500. Bolts 1512 may come equipped with washers 1514 and bolt 1516.

Figure 16:
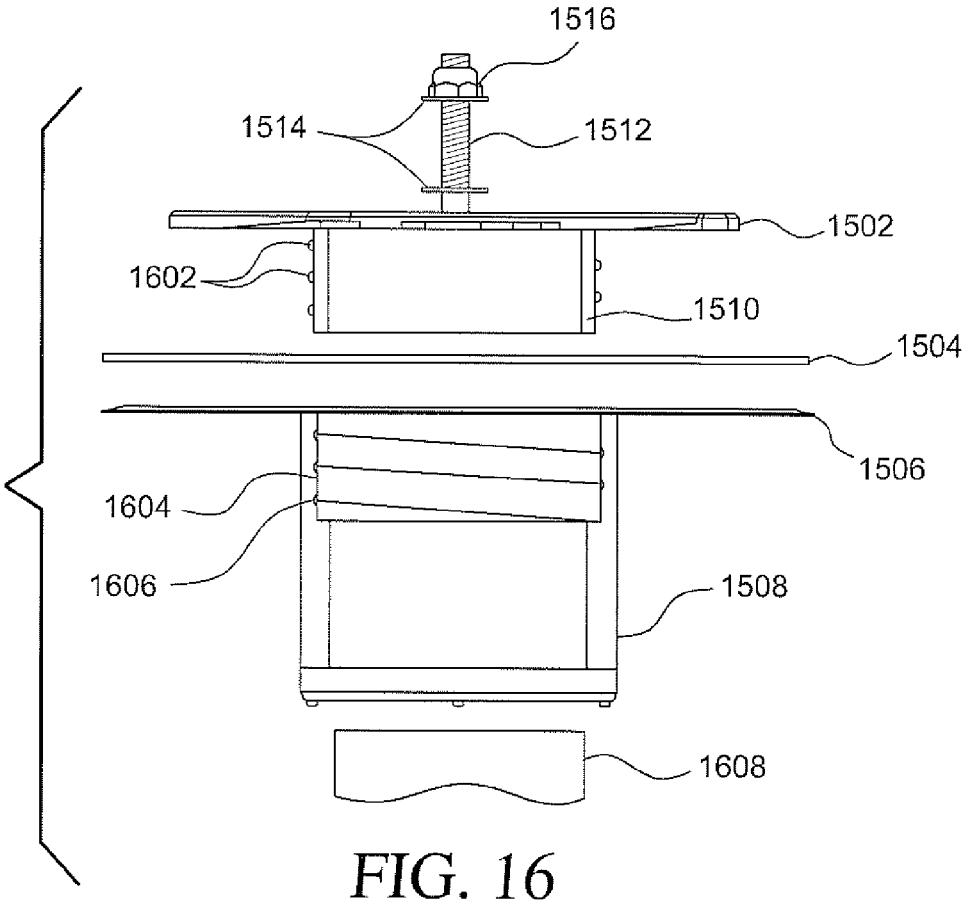
FIG. 16 shows an exploded view of the embodiment of FIG. 15

FIG. 16 shows an exploded view of the two-part closet flange of FIG. 15, in conjunction with a drainpipe 1608. Drainpipe 1608 fits telescopically into the lower end of hub portion 1508. The upper portion of hub 1508 includes an inner surface 1604. Cylindrical portion 1510 of clamping ring 1502 is then connected to surface 1604 of hub 1508 so that floor covering 1504 is sandwiched between clamping ring 1502 and annular flange 1506. In some embodiments, threading 1602 on the outer surface of cylindrical portion 1510 of clamping ring 1502 mates with threading 1606 on inner surface 1604 of hub 1508, allowing cylindrical portion 1510 to be screwed into surface 1604. In other embodiments, the outer surface of cylindrical portion 1510 of clamping ring 1502 and inner surface 1604 are not threaded; instead, surface 1604 and cylindrical portion 1510 slide together telescopically, and are adhesively connected.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A method of connecting a closet flange to a drainpipe extending through a subfloor, said method comprising:

providing a closet flange having (i) a hub comprising a first cylindrical portion, and (ii) a base flange extending from the hub;

telescopically connecting the first cylindrical portion to the drainpipe;

securing the base flange of the closet flange against a surface of the subfloor;

securing a flooring membrane to an upper surface of the base flange; and clamping the flooring membrane between the base flange and a clamping ring.

2. The method of claim 1, wherein the step of securing the flooring membrane comprises:

applying a first layer of sealant to the upper surface of the base flange; and attaching the flooring membrane to the first layer of sealant.

3. The method of claim 2, additionally comprising:

applying a second layer of sealant to an upper surface of the flooring membrane prior to the step of clamping;

wherein, after the step of clamping, the flooring membrane is positioned between the first layer of sealant and the second layer of sealant.

4. The method of claim 1, wherein the base flange extends from the first cylindrical portion.

5. The method of claim 1, wherein the base flange extends from a second cylindrical portion of the hub.

6. The method of claim 5, wherein the second cylindrical portion of the hub is coaxial with the first cylindrical portion of the hub.

7. The method of claim 1, wherein the base flange extends from a second cylindrical portion of the hub, the second cylindrical portion being fluidly connected with the first cylindrical portion of the hub.

8. The method of claim 3, wherein the step of clamping comprises:

positioning the clamping ring on the second layer of sealant, and securing the clamping ring to the subfloor.

9. The method of claim 3, wherein the step of clamping comprises:

positioning the clamping ring on the second layer of sealant, and securing the clamping ring to the subfloor with a threaded fastener passing through the base flange.

10. The method of claim 3, wherein:

a) the first cylindrical portion is below the base flange and the hub further comprises a second cylindrical portion above the base flange, the second cylindrical portion having an external surface with a first threaded joint;

b) the clamping ring has an internal surface with a second threaded joint; and c) the step of clamping comprises screwing the second threaded joint onto the first threaded joint until the clamping ring contacts the second layer of sealant.

11. The method of claim 1, wherein the step of securing the base flange of the closet flange against the upper surface of a subfloor comprises:

a) applying a layer of sealant to the subfloor;

b) fitting a sealant dam to an inner peripheral edge of a lower surface of the base flange; and c) securing the base flange to the subfloor through the layer of sealant.

12. The method of claim 1, wherein the step of securing the base flange of the closet flange against the upper surface of a subfloor comprises:

a) applying a layer of sealant to the subfloor;

b) fitting a sealant dam to an annular recess in a lower surface of the base flange; and c) securing the base flange to the subfloor through the layer of sealant.

13. A method of fitting a closet flange to existing construction having a finished floor, comprising:

providing a closet flange having a hub with a base flange extending from the hub, the hub having a first cylindrical portion;

fitting a sealant dam to an inner peripheral edge of a lower surface of the base flange;

telescopically fitting a surface of the cylindrical hub to an inner or outer surface of a drainpipe passing through a hole in the finished floor;

applying a layer of sealant to an upper surface of a finished floor; and securing the base flange to the finished floor or flooring membrane through the layer of sealant, wherein the sealant dam prevents sealant from entering the hole in the finished floor.

14. A closet flange for connection to a drain pipe, comprising:

a hub having a first cylindrical portion, the first cylindrical portion being adapted to telescopically connect to the drain pipe; and a clamp assembly comprising an annular flange radially extending from the hub; and a clamping ring;

wherein the clamp assembly is adapted to clamp a flooring membrane between the clamping ring and the annular flange.

15. The closet flange of claim 12, wherein the annular flange extends from the first cylindrical portion of the hub.

16. The closet flange of claim 12, wherein the annular flange extends from a second cylindrical portion of the hub, wherein the first cylindrical portion and the second cylindrical portion are coaxial.

17. The closet flange of claim 12, wherein the base flange extends from a second cylindrical portion of the hub.

18. The closet flange of claim 12, further comprising a bolt, wherein the bolt secures the clamping ring and the annular flange to a subfloor, the flooring membrane being between the clamping ring and the annular flange.

19. A closet flange according to claim 12, further comprising:

a first threaded surface on an interior surface of the clamping ring;

an annular flange radially extending from a lower edge of the clamping ring; and a second threaded surface on an exterior surface of the hub, the second threaded surface extending above the annular flange radially extending from the cylindrical hub;

the first threaded surface being adapted to screw onto the second threaded surface so as to clamp a flooring membrane between the annular flange radially extending from a lower edge of the clamping ring and the annular flange radially extending from the cylindrical hub.

20. A closet flange seal for connection to a drain pipe, comprising:

a hub having a first cylindrical portion, the first cylindrical portion being adapted to telescopically connect to the drain pipe; and an annular flange radially extending from the hub;

a clamping ring; and a means for clamping a flooring membrane between the clamping ring and the annular flange.

21. A closet flange seal according to claim 18, wherein the clamping means comprises a bolt securing the clamping ring and the annular flange to a subfloor.

22. A closet flange seal according to claim 18, wherein the clamping means comprises:

a first threaded surface on an interior surface of the clamping ring;

an annular flange radially extending from a lower edge of the clamping ring; and a second threaded surface on an exterior surface of the hub, the second threaded surface extending above the annular flange radially extending from the cylindrical hub;

the first threaded surface being adapted to screw onto the second threaded surface so as to clamp a flooring membrane between the annular flange radially extending from a lower edge of the clamping ring and the annular flange radially extending from the cylindrical hub.

23. A closet flange seal according to claim 18, wherein the clamping means comprises:

a first threaded surface on an exterior surface of the clamping ring;

an annular flange radially extending from an upper edge of the clamping ring; and a second threaded surface on an interior surface of the hub;

the first threaded surface being adapted to screw onto the second threaded surface so as to clamp a flooring membrane between the annular flange radially extending from an upper edge of the clamping ring and the annular flange radially extending from the cylindrical hub.

* * * * *